US009255416B1

(12) United States Patent
Snell et al.

(10) Patent No.: US 9,255,416 B1
(45) Date of Patent: Feb. 9, 2016

(54) CONSTRUCTION HOIST SYSTEM

(71) Applicants: Eric Snell, Aberdeen, WA (US); Matt Hultman, Montesano, WA (US)

(72) Inventors: Eric Snell, Aberdeen, WA (US); Matt Hultman, Montesano, WA (US)

( * ) Notice: Subject to any disclaimer, the term of this patent is extended or adjusted under 35 U.S.C. 154(b) by 0 days.

(21) Appl. No.: 14/719,102

(22) Filed: May 21, 2015

Related U.S. Application Data

(60) Provisional application No. 62/127,080, filed on Mar. 2, 2015, provisional application No. 62/155,866, filed on May 1, 2015.

(51) Int. Cl.

| | |
|---|---|
| ***E04G 21/16*** | (2006.01) |
| ***B66C 23/82*** | (2006.01) |
| ***B66C 23/06*** | (2006.01) |
| ***B66C 23/26*** | (2006.01) |

(52) U.S. Cl.
CPC ..... *E04G 21/16* (2013.01); *B66C 23/06* (2013.01); *B66C 23/26* (2013.01); *B66C 23/82* (2013.01); *E04G 21/166* (2013.01)

(58) Field of Classification Search
USPC ..... 254/338; 212/179, 271
See application file for complete search history.

(56) References Cited

U.S. PATENT DOCUMENTS

| | | | | | |
|---|---|---|---|---|---|
| 1,574,801 | A * | 3/1926 | Eddington | A47L 3/02 | 182/57 |
| 2,696,917 | A * | 12/1954 | Kershaw | E01B 29/00 | 105/162 |
| 3,591,022 | A | 7/1971 | Polyakov et al. | | |
| 3,679,026 | A * | 7/1972 | Hansen | E04G 3/18 | 182/128 |
| 4,010,852 | A | 3/1977 | Goss et al. | | |
| 4,021,019 | A | 5/1977 | Sanders | | |
| 4,068,827 | A | 1/1978 | Fanning et al. | | |
| 4,444,289 | A | 4/1984 | Jungman | | |
| 4,456,093 | A | 6/1984 | Finley et al. | | |
| 4,496,277 | A * | 1/1985 | Jungman | B66C 23/20 | 212/179 |
| 4,951,779 | A * | 8/1990 | Tseng | A62B 1/02 | 182/14 |
| 4,962,828 | A | 10/1990 | Duncan | | |
| 5,181,825 | A * | 1/1993 | Sugitani | B66C 1/16 | 187/900 |
| 5,341,898 | A | 8/1994 | Baziuk | | |
| 5,622,237 | A | 4/1997 | Moldow | | |
| 5,934,437 | A * | 8/1999 | Anson | B66C 23/202 | 193/15 |
| 6,041,949 | A * | 3/2000 | Walker | B66C 9/08 | 212/179 |
| 6,499,610 | B2 | 12/2002 | Spitsbergen | | |
| 6,539,676 | B2 | 4/2003 | Price | | |
| 6,575,685 | B2 * | 6/2003 | Baxter, Sr. | B66C 23/201 | 187/900 |
| 7,048,491 | B2 | 5/2006 | Windbergs | | |
| 7,070,020 | B2 * | 7/2006 | Preston | E04G 3/28 | 182/82 |
| 7,815,014 | B2 | 10/2010 | Preston | | |
| 7,891,718 | B2 | 2/2011 | Heinaman | | |
| 8,167,153 | B1 * | 5/2012 | Wattel | B66C 23/166 | 182/45 |
| 8,566,992 | B1 | 10/2013 | Stokes | | |
| 8,584,801 | B2 * | 11/2013 | Baxter | B66C 23/205 | 182/141 |
| 9,109,394 | B2 | 8/2015 | Hernandez | | |

(Continued)

FOREIGN PATENT DOCUMENTS

| | | |
|---|---|---|
| WO | 9506794 | 3/1995 |

*Primary Examiner* — Emmanuel M Marcelo
*Assistant Examiner* — Angela K Caligiuri

(57) ABSTRACT

This invention relates generally to a method for using a deck in construction. In one embodiment, a technique includes, but is not limited to, positioning a deck on a floor of a building, the deck including at least a stationary support structure and a slidable platform; and extending the slidable platform relative to the stationary support structure beyond an edge of the floor of the building at least partly using one or more wheels of the slidable platform that rest directly or indirectly on the floor of the building.

19 Claims, 8 Drawing Sheets

(56) References Cited

U.S. PATENT DOCUMENTS

2003/0029825 A1* 2/2003 Baxter, Sr. ..... B66C 23/201 212/179
2003/0178254 A1 9/2003 Swanenberg et al.
2004/0175259 A1 9/2004 Singh et al.
2005/0236352 A1 10/2005 Tien
2011/0147329 A1* 6/2011 Evans ..... B66C 23/22 212/179
2012/0241403 A1 9/2012 Ethington
2013/0001012 A1* 1/2013 Solhjem ..... B66F 11/04 182/69.6
2014/0117296 A1* 5/2014 Shrader ..... B66F 9/18 254/278
2014/0119866 A1* 5/2014 Pruskauer ..... B66D 1/605 414/609
2014/0209735 A1* 7/2014 Corey ..... A62B 1/02 244/1 A
2015/0152656 A1 6/2015 Mckeon

* cited by examiner

CONSTRUCTION HOIST SYSTEM

PRIORITY CLAIM

This application claims priority to and/or the benefit of U.S. provisional patent application Ser. No. 62/127,080 filed Mar. 2, 2015 and U.S. provisional patent application Ser. No. 62/155,866 filed May 1, 2015. The foregoing applications are incorporated by reference in their entirety as if fully set forth herein.

FIELD OF THE INVENTION

This invention relates generally to a method for using a deck in construction.

SUMMARY

This invention relates generally to a method for using a deck in construction. For example, the deck can be placed near an edge of a floor of a building under construction and a load can be placed on the slidable platform. The slidable platform can be extended beyond the edge of the floor to facilitate access to the load by a hoist, lift, crane, or other similar system. Alternatively, the slidable platform can be extended beyond the edge of the floor to receive a load from a hoist, lift, crane, or other similar system. The slidable platform can then be retracted within the edge of the floor to facilitate removal of the load onto the floor. This deck and slidable platform can improve safety because the slidable platform and the deck can be maintained substantially entirely within the edge of the floor when not in use so as to limit their interference. Furthermore, the design of the deck and platform can increase the amount of weight the platform can carry and also limit the need for shore posts. This can permit the deck and slidable platform to be used in situations where there is no top structure, such as on a roof, or when the top structure has limited strength. Other uses of the deck and slidable platform are possible. For example, the deck and slidable platform can be used proximate to a hole instead of a near a building edge. Furthermore, the deck and platform can include additional structures as disclosed herein, such as an integrated hoist.

In one embodiment, a deck for use in construction is provided, the deck including, but not being limited to, a stationary support structure that is positionable on a floor of a building, the stationary support structure including at least: a first box tube; a second box tube disposed substantially parallel to the first box tube; a plate that extends between the first box tube and the second box tube; and at least one hydraulic cylinder mounted on the plate; a first extension member that is slidably disposed within the first box tube; a second extension member that is slidably disposed within the second box tube; a beam that extends between the first and second extension members, the beam coupled to the at least one hydraulic cylinder; and a platform that is detached from the first box tube and the second box tube and that is coupled to the beam, the platform including at least one wheel operable to roll on the plate for distributing at least some weight from the platform to the floor of the building, wherein the platform is operable to retractably extend beyond an edge of the floor in conjunction with the first and second extension members in response to actuation of the at least one hydraulic cylinder.

In another embodiment, the deck further includes, but is not limited to, at least one scale associated with the platform.

In another embodiment, the deck further includes, but is not limited to, at least one shore post that extends from the stationary support structure.

In another embodiment, the deck further includes, but is not limited to, at least one counterweight receptacle coupled to the stationary support structure that is operable to removably receive one or more counterweights.

In another embodiment, the deck further includes, but is not limited to, one or more removable counterweights.

In another embodiment, the deck further includes, but is not limited to, a fold-away ramp coupled to the stationary support structure that is operable to facilitate transfer of one or more loads with respect to the platform.

In another embodiment, the deck further includes, but is not limited to, at least one guard rail associated with the platform.

In another embodiment, the deck further includes, but is not limited to, a hoist mounted on the stationary support structure such that the hoist is operable to project from inside the edge of the floor to a point beyond the edge of the floor for lifting one or more loads.

In another embodiment, the deck further includes, but is not limited to, at least one scale associated with the hoist.

In another embodiment, the deck further includes, but is not limited to, a hoist including at least a mast mounted on the stationary support structure and at least one boom that projects from the mast or the stationary support structure.

In another embodiment, the deck further includes, but is not limited to, a hoist including at least a luffing device that extends from the mast to the at least one boom for adjusting pitch or angle of the at least one boom.

In another embodiment, the deck further includes, but is not limited to, a luffing device including at least one of a hydraulic cylinder or a cable.

In another embodiment, the deck further includes, but is not limited to, a hoist including at least a winch; a sheave; a cable that extends from the winch over the sheave; and an overhaul ball coupled to the cable.

In another embodiment, the deck further includes, but is not limited to, a hoist that is height adjustable relative to the stationary support structure.

In another embodiment, the deck further includes, but is not limited to, a hoist is position adjustable along a length of the stationary support structure.

In another embodiment, the deck further includes, but is not limited to, a hoist is removably mounted on the stationary support structure.

In one embodiment, a deck for use in construction is provided, the deck including, but not limited to, a stationary support structure that is positionable on a floor of a building, the stationary support structure including at least: a first box tube; a second box tube disposed substantially parallel to the first box tube; a plate that extends between the first box tube and the second box tube; at least one hydraulic cylinder mounted on the plate; and at least one counterweight receptacle; a first extension member that is slidably disposed within the first box tube; a second extension member that is slidably disposed within the second box tube; a beam that extends between the first and second extension members, the beam coupled to the at least one hydraulic cylinder; a platform that is detached from the first box tube and the second box tube and that is coupled to the beam, the platform including at least one wheel operable to roll on the plate for distributing at least some weight from the platform to the floor of the building, wherein the platform is operable to retractably extend beyond an edge of the floor in conjunction with the first and second extension members in response to actuation of the at least one hydraulic cylinder; and a hoist mounted on the stationary support structure such that the hoist is operable to project from inside the edge of the floor to a point beyond the edge of the floor for lifting one or more loads.

In one embodiment a deck for use in construction is provided, the deck including, but not limited to at least one fixed member positionable on a floor of a building, the at least one fixed member including at least one drive mechanism coupled thereto or disposed therein; at least one extension member that is coupled to the at least one drive mechanism, the at least one extension member operable to retractably extend from the at least one fixed member beyond an edge of the floor in response to actuation of the at least one drive mechanism; and a platform that is detached from the at least one fixed member and that is coupled to the at least one extension member such that the platform is operable to retractably extend beyond the edge of the floor in conjunction with the at least one extension member, the platform including at least one wheel operable to interface directly or indirectly with the floor of the building for distributing at least some weight from the platform to the floor of the building.

In one embodiment, a method for making a deck for use in construction includes, but is not limited to, positioning a first box tube substantially parallel to a second box tube; attaching a plate to the first box tube and the second box tube, the plate extending between the first box tube and the second box tube; coupling a hydraulic cylinder to the plate; slidably inserting a first extension member at least partially into the first box tube; slidably inserting a second extension member at least partially into the second box tube, the first and second extension members having a beam extending therebetween; coupling the hydraulic cylinder to the beam; positioning a platform having one or more wheels on the plate and over the hydraulic cylinder such that the platform is rollable relative to the plate; and attaching the platform to the beam such that the platform is operable to retractably extend beyond an edge of a floor of a building in conjunction with the first and second extension members in response to actuation of the at least one hydraulic cylinder.

In one embodiment, a deck for use in construction is provided, the deck including, but not limited to, a stationary support structure that is positionable on a floor of a building; at least one extension member that is operable to retractably extend from the stationary support structure; and a platform that includes one or more wheels for interfacing directly or indirectly with the floor and that is coupled to the at least one extension member, wherein the platform is operable to retractably extend beyond an edge of the floor in conjunction with the at least one extension member.

In another embodiment, the deck further includes, but is not limited to, a drive mechanism operable to extend and retract the at least one extension member.

In another embodiment, the deck further includes, but is not limited to, a drive mechanism including at least one of: a hydraulic cylinder, a chain, or a self-propelled wheel.

In another embodiment, the deck further includes, but is not limited to, at least one shore post that extends from the stationary support structure.

In another embodiment, the deck further includes, but is not limited to, at least one counterweight receptacle coupled to the stationary support structure that is operable to removably receive one or more counterweights.

In another embodiment, the deck further includes, but is not limited to, one or more removable counterweights.

In another embodiment, the deck further includes, but is not limited to, a fold-away ramp coupled to the stationary support structure that is operable to facilitate transfer of one or more loads with respect to the platform.

In another embodiment, the deck further includes, but is not limited to, at least one guard rail associated with the platform.

In another embodiment, the deck further includes, but is not limited to, a hoist mounted on the stationary support structure such that the hoist is operable to project from inside the edge of the floor to a point beyond the edge of the floor for lifting one or more loads.

In another embodiment, the deck further includes, but is not limited to, a hoist including at least a mast mounted on the stationary support structure; and at least one boom that projects from the mast or the stationary support structure.

In another embodiment, the deck further includes, but is not limited to, a hoist including at least a luffing hydraulic cylinder that extends from the mast to the at least one boom for adjusting pitch or angle of the at least one boom.

In another embodiment, the deck further includes, but is not limited to, a hoist including at least a winch; a sheave; a cable that extends from the winch over the sheave; and an overhaul ball coupled to the cable.

In another embodiment, the deck further includes, but is not limited to, a hoist that is height adjustable relative to the stationary support structure.

In another embodiment, the deck further includes, but is not limited to, a hoist that is position adjustable along a length of the stationary support structure.

In another embodiment, the deck further includes, but is not limited to, a hoist that is removably mounted on the stationary support structure.

In one embodiment, a deck for use in construction is provided, the deck including, but not limited to, a stationary support structure that is positionable on a floor of a building and that includes at least one counterweight receptacle; at least one extension member that is operable to retractably extend from the stationary support structure; a platform that includes one or more wheels for interfacing directly or indirectly with the floor and that is coupled to the at least one extension member, wherein the platform is operable to retractably extend beyond an edge of the floor in conjunction with the at least one extension member; and a hoist mounted on the stationary support structure such that the hoist is operable to project from inside the edge of the floor to a point beyond the edge of the floor for lifting one or more loads.

In one embodiment, a technique for use in construction is provided, the technique including, but not limited to, positioning a deck on a floor of a building, the deck including at least a stationary support structure and a slidable platform; and extending the slidable platform relative to the stationary support structure beyond an edge of the floor of the building at least partly using one or more wheels of the slidable platform that rest directly or indirectly on the floor of the building.

In one embodiment, a hoist for use in construction is provided, the hoist including, but not limited to a stationary support structure; a mast mounted on the stationary support structure; at least one boom that projects from the stationary support structure or the mast; and a platform slidable relative to the stationary support structure for receiving or delivery one or more loads, wherein the hoist is operable to project from inside an edge of a floor of a building to a point beyond the edge of the floor for lifting or depositing the one or more loads with respect to the platform.

In another embodiment, the hoist includes, but is not limited to, at least one shore post that extends from the stationary support structure.

In another embodiment, the hoist includes, but is not limited to, at least one counterweight receptacle coupled to the stationary support structure that is operable to removably receive one or more counterweights.

In another embodiment, the hoist includes, but is not limited to, one or more removable counterweights.

In another embodiment, the hoist includes, but is not limited to, a ramp coupled to the stationary support structure that is operable to facilitate transfer of one or more loads.

In another embodiment, the hoist includes, but is not limited to, at least one guard rail associated with the stationary support structure.

In another embodiment, the hoist includes, but is not limited to, a winch; a sheave; a cable that extends from the winch over the sheave; and an overhaul ball coupled to the cable.

In another embodiment, the hoist includes, but is not limited to, the mast being height adjustable.

In another embodiment, the hoist includes, but is not limited to, the mast being position adjustable.

In another embodiment, the hoist includes, but is not limited to, the mast being removable.

In another embodiment, the hoist includes, but is not limited to, at least one back brace that extends from the mast to the stationary support structure.

In another embodiment, the hoist includes, but is not limited to, at least one front brace that extends from the mast to the boom.

In another embodiment, the hoist includes, but is not limited to, wherein the at least one front brace is fixed.

In another embodiment, the hoist includes, but is not limited to, wherein the at least one front brace includes a hydraulic cylinder for adjusting pitch or angle of the boom.

In another embodiment, the hoist includes, but is not limited to, at least one front brace including a hydraulic cylinder for adjusting pitch or angle of the boom, the hydraulic cylinder being programmed to stop at one or more pre-specified positions.

In another embodiment, the hoist includes, but is not limited to, at least one hydraulic cylinder coupled to the stationary support structure and the platform.

In another embodiment, the hoist includes, but is not limited to, wherein the stationary support structure comprises a first beam; a second beam disposed substantially parallel to the first beam; a plate that extends between the first beam and the second beam; and at least one hydraulic cylinder mounted on the plate.

In another embodiment, the hoist includes, but is not limited to, wherein the stationary support structure comprises a first beam; a second beam disposed substantially parallel to the first beam; a plate that extends between the first beam and the second beam; at least one hydraulic cylinder mounted on the plate, a first extension member that is slidably disposed on or in the first beam; and a second extension member that is slidably disposed on or in the second beam, the first and second extension members having a cross-beam extending therebetween, the at least one hydraulic cylinder coupled to the cross-beam, wherein the platform is coupled to the cross-beam and wherein the platform is operable to retractably extend in response to actuation of the at least one hydraulic cylinder.

In one embodiment, a hoist for use in building construction is provided, the hoist including, but not limited to, a stationary support structure positionable on a floor of a building; a lift coupled to the stationary support structure; and a platform slidable relative to the stationary support structure at least partly using one or more rollers or wheels operable to interface directly or indirectly with the floor, wherein the lift is operable to project from inside an edge of the floor of the building to a point beyond the edge of the floor for lifting or depositing one or more loads with respect to the platform.

BRIEF DESCRIPTION OF THE DRAWINGS

Embodiments of the present invention are described in detail below with reference to the following drawings.

DETAILED DESCRIPTION

This invention relates generally to a method for using a deck in construction. Specific details of certain embodiments of the invention are set forth in the following description and in FIGS. 1-8 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
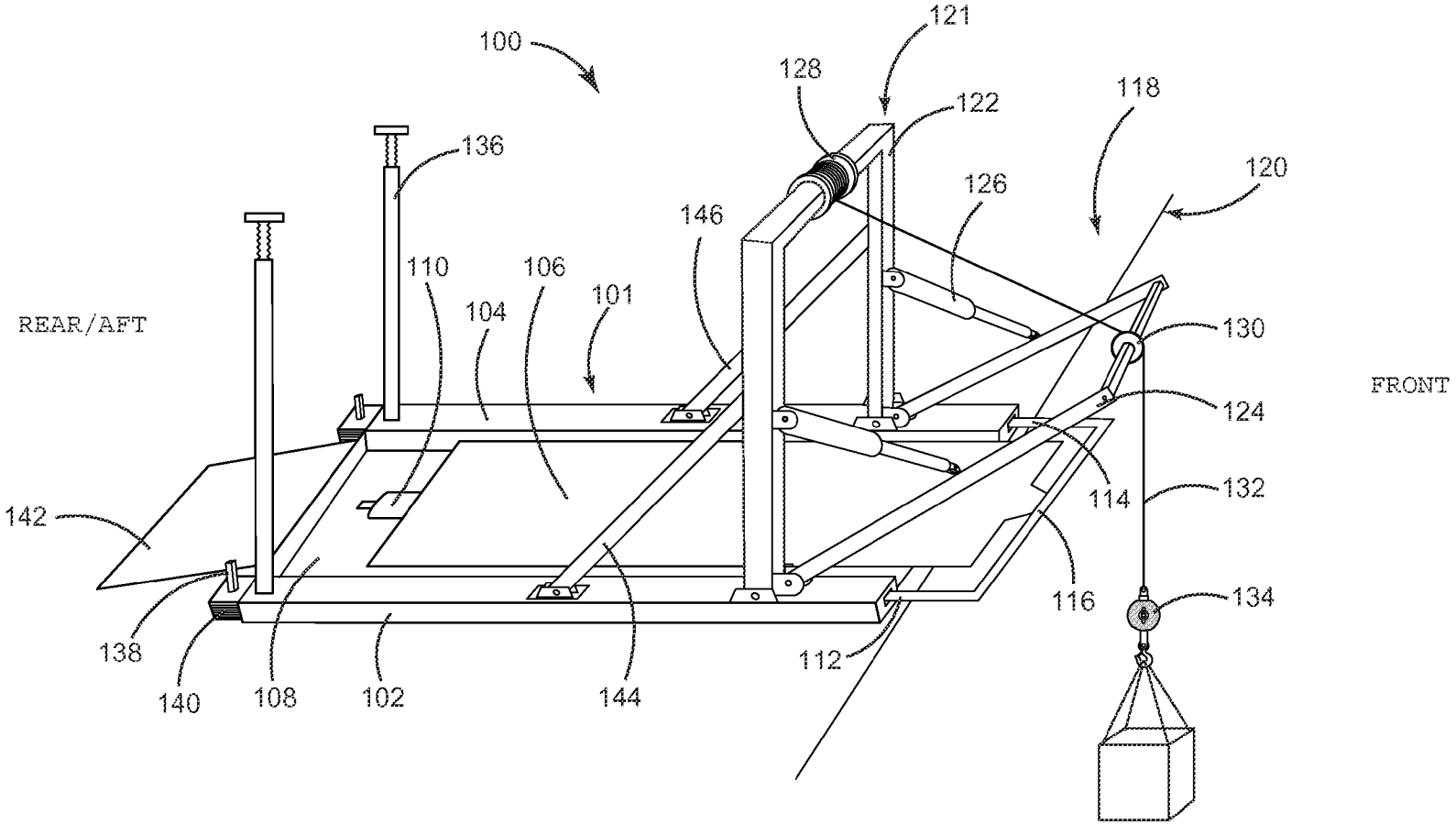
FIG. 1 is a perspective view of a deck, in accordance with an embodiment of the invention.

FIG. 1 is a perspective view of a deck 100, in accordance with an embodiment of the invention. In one embodiment, a deck 100 is provided for use in construction, the deck 100 including, but not limited to, a stationary support structure 101 that is positionable on a floor 118 of a building, the stationary support structure 101 including at least a first box tube 102; a second box tube 104 disposed substantially parallel to the first box tube 102; a plate 108 that extends between the first box tube 102 and the second box tube 104; and at least one hydraulic cylinder 110 mounted on the plate 108; a first extension member 112 that is slidably disposed within the first box tube 102; a second extension member 114 that is slidably disposed within the second box tube 104; a beam 116 that extends between the first 112 and second 114 extension members, the beam 116 coupled to the at least one hydraulic cylinder 110; and a platform 106 that is detached from the first box tube 102 and the second box tube 104 and that is coupled to the beam 116, the platform 106 including at least one wheel (not visible) operable to roll on the plate 108 for distributing at least some weight from the platform 106 to the floor 118 of the building, wherein the platform 106 is operable to retractably extend beyond an edge 120 of the floor 118 in conjunction with the first 112 and second 114 extension members in response to actuation of the at least one hydraulic cylinder 110.

In a further embodiment, the deck 100 further includes, but is not limited to, a hoist 121 operable to project from inside the edge 120 of the floor 118 to a point beyond the edge 120 of the floor 118, the hoist 121 including at least a mast 122 mounted on the stationary support structure 101 (e.g., on the first 102 and the second 104 box tubes); at least one boom 124 that projects from the mast 122 or the stationary support structure 101 (e.g., from the first 102 and the second 104 box tubes); a luffing device 126 (e.g. a hydraulic cylinder or cable) that extends from the mast 122 to the at least one boom 124 for adjusting pitch or angle of the at least one boom 124; a winch 128; a sheave 130; a cable 132 that extends from the winch 128 over the sheave 130; and an overhaul ball 134 coupled to the cable 132.

In a further embodiment, the deck 100 further includes, but is not limited to, at least one scale (not visible) associated with the platform 106. In a further embodiment, the deck 100 further includes, but is not limited to, at least one shore post 136 that extends from the stationary support structure 101. In a further embodiment, the deck 100 further includes, but is not limited to, at least one counterweight receptacle 138 coupled to the stationary support structure 101 that is operable to removably receive one or more counterweights 140. In a further embodiment, the deck 100 further includes, but is not limited to, one or more removable counterweights 140. In a further embodiment, the deck 100 further includes, but is not limited to, a fold-away ramp 142 coupled to the stationary support structure 101 that is operable to facilitate transfer of one or more loads with respect to the platform 106. In a further embodiment, the deck 100 further includes, but is not limited to, at least one guard rail (see FIGS. 3 and 4) associated with the platform 106. In a further embodiment, the deck 100 further includes, but is not limited to, a hoist 121 with a scale (not visible). In a further embodiment, the deck 100 further includes, but is not limited to, a hoist 121 that is height adjustable relative to the stationary support structure 101. In a further embodiment, the deck 100 further includes, but is not limited to, a hoist 121 that is position adjustable along a length of the stationary support structure 101. In a further embodiment, the deck 100 further includes, but is not limited to, a hoist 121 that is removably mounted on the stationary support structure 101.

In certain embodiments, the first 102 and second 104 box tubes can be substituted with at least one fixed member, such as an i-beam, beam, rod, plate, pole, rail, or the like. In certain embodiments, the hydraulic 110 can be substituted with at least one drive mechanism such as a chain, screw, cable, magnets, motor, self-propelled wheel, or the like. In certain embodiments, the luffing device 126 can be substituted with a fixed brace. In certain embodiments, the wheels (not visible) of the platform 106 can be substituted with rollers, bearings, skids, pads, magnets, or the like, which can also be disposed on the plate 108. In certain embodiments, the deck 100 includes a hoist 121 with (i) a first back brace 144 that extends between the mast 122 and the first box tube 102 and (ii) a second back brace 146 that extends between the mast 122 and the second box tube 104. In certain embodiments, the luffing device 126 is programmed to stop at one or more pre-specified positions. In certain embodiments, the first 112 and second 114 extension members are configured to slide on or within any fixed member (such as against rollers, wear pads, tracks, or the like). In certain embodiments, the hoist 121 may be substituted with any lifting device. In certain embodiments, the hoist 121 is rotatable relative to the stationary support structure 101. In other embodiments, the fold-away ramp 142 is merely a ramp that is not foldable and/or which may be controllably raised or lowered. In certain embodiments, the overhaul ball 134 may be controllably rotatable.

In certain embodiments, stationary support structure 101 may be a single unitary structure. In certain embodiments the first 112 and second 114 extension members and the beam 116 may be a single unitary structure. In certain embodiments, the plate 108 can be omitted and/or substituted with a beam or rod. In certain embodiments, the hydraulic 110 may be disposed within one or both of the first 102 and second 104 box tubes.

Figure 2:
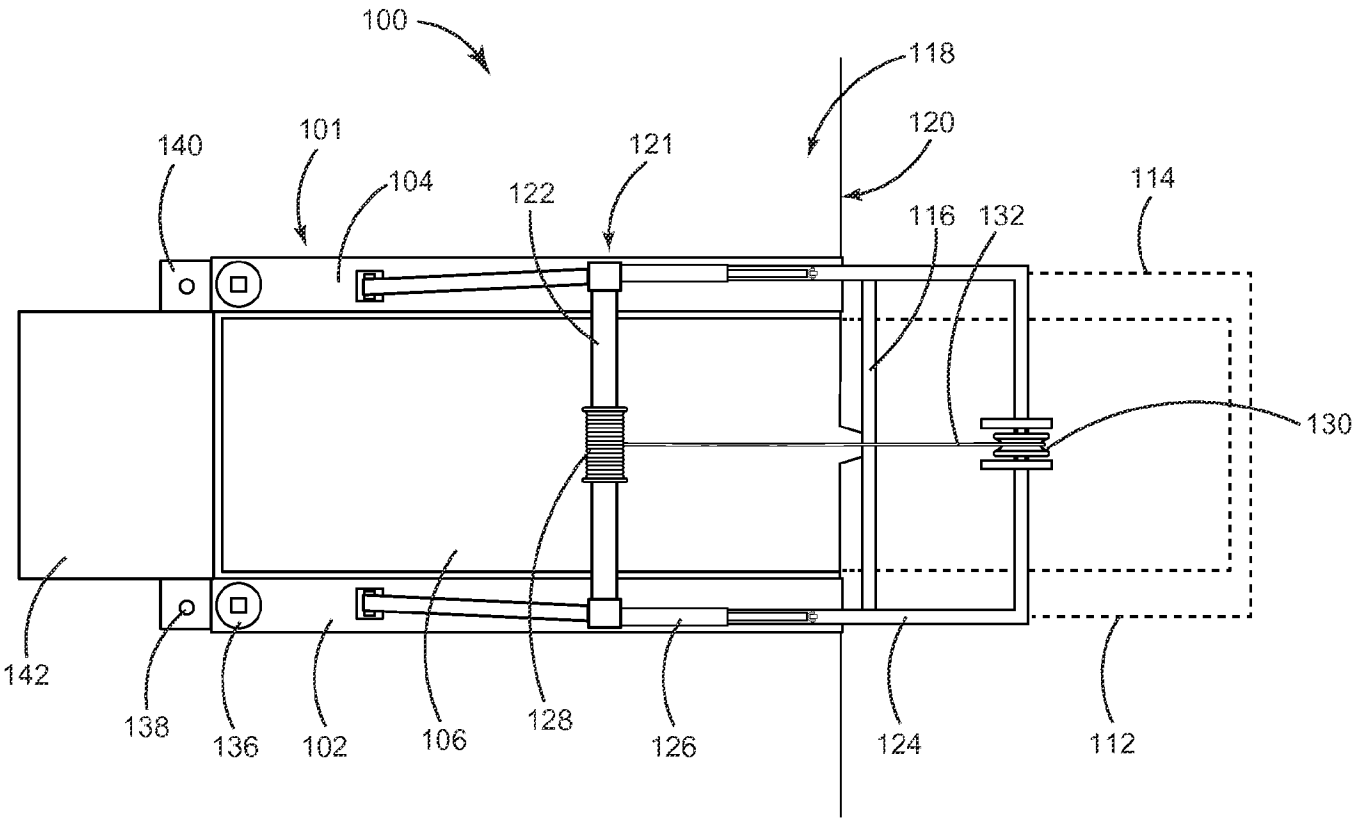
FIG. 2 is a top down view of a deck, in accordance with an embodiment of the invention.

FIG. 2 is a top down view of a deck 100, in accordance with an embodiment of the invention. In one embodiment, a deck 100 is provided for use in construction, the deck 100 including, but not limited to, a stationary support structure 101 that is positionable on a floor 118 of a building, the stationary support structure 101 including at least a first box tube 102; a second box tube 104 disposed substantially parallel to the first box tube 102; a plate (not visible) that extends between the first box tube 102 and the second box tube 104; and at least one hydraulic cylinder (not visible) mounted on the plate (not visible); a first extension member 112 that is slidably disposed within the first box tube 102; a second extension member 114 that is slidably disposed within the second box tube 104; a beam 116 that extends between the first 112 and second 114 extension members, the beam 116 coupled to the at least one hydraulic cylinder (not visible); and a platform 106 that is detached from the first box tube 102 and the second box tube 104 and that is coupled to the beam 116, the platform 106 including at least one wheel (not visible) operable to roll on the plate (not visible) for distributing at least some weight from the platform 106 to the floor 118 of the building, wherein the platform 106 is operable to retractably extend beyond an edge 120 of the floor 118 in conjunction with the first 112 and second 114 extension members in response to actuation of the at least one hydraulic cylinder (not visible).

In a further embodiment, the deck 100 further includes, but is not limited to, a hoist 121 operable to project from inside the edge 120 of the floor 118 to a point beyond the edge 120 of the floor 118, the hoist 121 including at least a mast 122 mounted on the stationary support structure 101 (e.g., on the first 102 and the second 104 box tubes); at least one boom 124 that projects from the mast 122 or the stationary support structure 101 (e.g., from the first 102 and the second 104 box tubes); a luffing device 126 (e.g. a hydraulic cylinder or cable) that extends from the mast 122 (or the stationary support structure 101) to the at least one boom 124 for adjusting pitch or angle of the at least one boom 124; a winch 128; a sheave 130; a cable 132 that extends from the winch 128 over the sheave 130; and an overhaul ball (not visible) coupled to the cable 132.

In a further embodiment, the deck 100 further includes, but is not limited to, at least one scale (not visible) associated with the platform 106. In a further embodiment, the deck 100 further includes, but is not limited to, at least one shore post 136 that extends from the stationary support structure 101. In a further embodiment, the deck 100 further includes, but is not limited to, at least one counterweight receptacle 138 coupled to the stationary support structure 101 that is operable to removably receive one or more counterweights 140. In a further embodiment, the deck 100 further includes, but is not limited to, one or more removable counterweights 140. In a further embodiment, the deck 100 further includes, but is not limited to, a fold-away ramp 142 coupled to the stationary support structure 101 that is operable to facilitate transfer of one or more loads with respect to the platform 106. In a further embodiment, the deck 100 further includes, but is not limited to, at least one guard rail (see FIGS. 3 and 4) associated with the platform 106. In a further embodiment, the deck 100 further includes, but is not limited to, a hoist 121 with a scale (not visible). In a further embodiment, the deck 100 further includes, but is not limited to, a hoist 121 that is height adjustable relative to the stationary support structure 101. In a further embodiment, the deck 100 further includes, but is not limited to, a hoist 121 that is position adjustable along a length of the stationary support structure 101. In a further embodiment, the deck 100 further includes, but is not limited to, a hoist 121 that is removably mounted on the stationary support structure 101.

Figure 3:
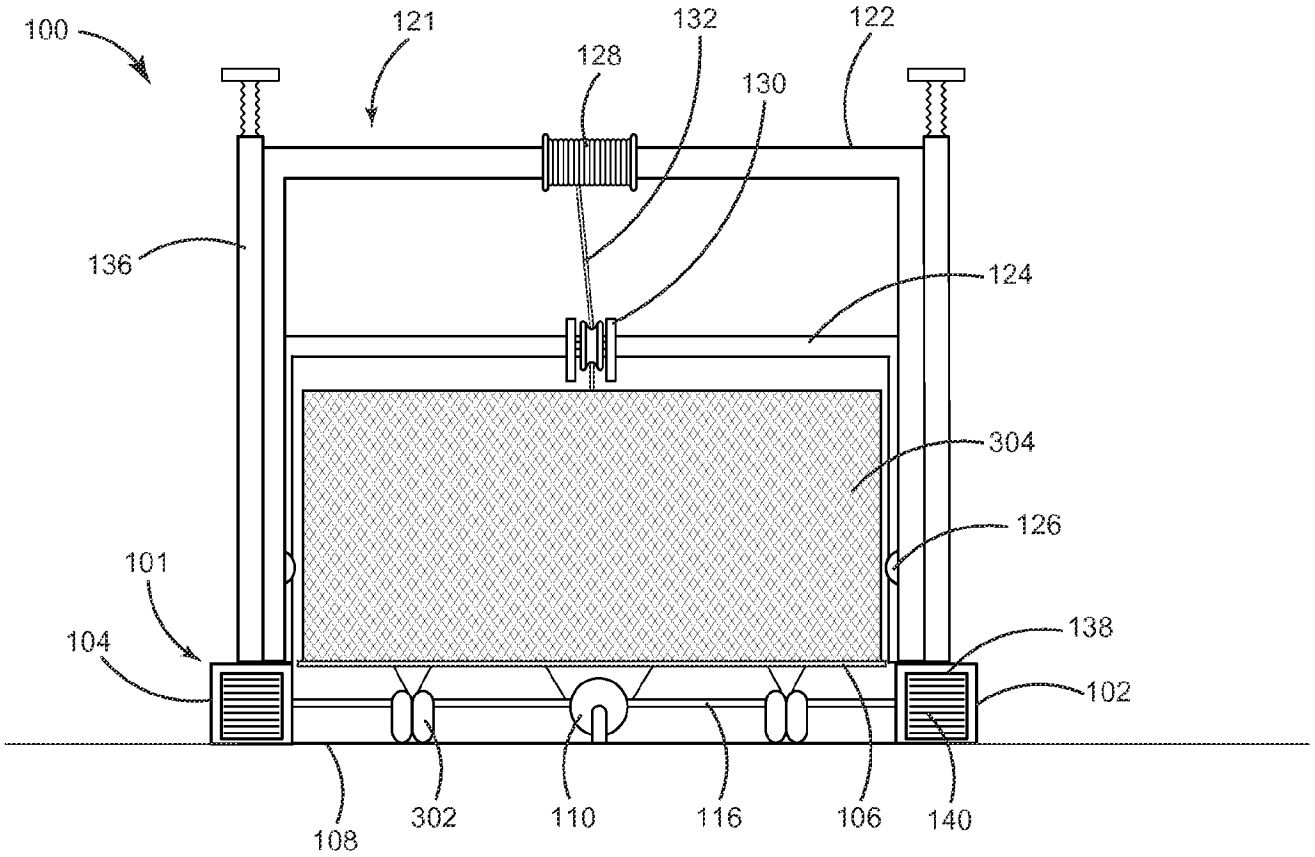
FIG. 3 is a rear side view of a deck, in accordance with an embodiment of the invention.

FIG. 3 is a rear side view of a deck (i.e., from the perspective of inside a building looking out toward an edge of the building when the deck is being used), in accordance with an embodiment of the invention. In one embodiment, a deck 100 is provided for use in construction, the deck 100 including, but not limited to, a stationary support structure 101 that is positionable on a floor 118 of a building, the stationary support structure 101 including at least a first box tube 102; a second box tube 104 disposed substantially parallel to the first box tube 102; a plate 108 that extends between the first box tube 102 and the second box tube 104; and at least one hydraulic cylinder 110 mounted on the plate 108; a first extension member (not visible) that is slidably disposed within the first box tube 102; a second extension member (not visible) that is slidably disposed within the second box tube 104; a beam 116 that extends between the first and second extension members (not visible), the beam 116 coupled to the at least one hydraulic cylinder 110; and a platform 106 that is detached from the first box tube 102 and the second box tube 104 and that is coupled to the beam 116, the platform 106 including at least one wheel 302 operable to roll on the plate 108 for distributing at least some weight from the platform 106 to the floor 118 of the building, wherein the platform 106 is operable to retractably extend beyond an edge (not visible) of the floor 118 in conjunction with the first and second extension members (not visible) in response to actuation of the at least one hydraulic cylinder 110.

In a further embodiment, the deck 100 further includes, but is not limited to, a hoist 121 operable to project from inside the edge (not visible) of the floor 118 to a point beyond the edge of the floor 118, the hoist 121 including at least a mast 122 mounted on the stationary support structure 101 (e.g., on the first 102 and the second 104 box tubes); at least one boom 124 that projects from the mast 122 or the stationary support structure 101 (e.g., from the first 102 and the second 104 box tubes); a luffing device 126 (e.g. a hydraulic cylinder or cable) that extends from the mast 122 to the at least one boom 124 for adjusting pitch or angle of the at least one boom 124; a winch 128; a sheave 130; a cable 132 that extends from the winch 128 over the sheave 130; and an overhaul ball (not visible) coupled to the cable 132.

In a further embodiment, the deck 100 further includes, but is not limited to, at least one scale (not visible) associated with the platform 106. In a further embodiment, the deck 100 further includes, but is not limited to, at least one shore post 136 that extends from the stationary support structure 101. In a further embodiment, the deck 100 further includes, but is not limited to, at least one counterweight receptacle 138 coupled to the stationary support structure 101 that is operable to removably receive one or more counterweights 140. In a further embodiment, the deck 100 further includes, but is not limited to, one or more removable counterweights 140. In a further embodiment, the deck 100 further includes, but is not limited to, a fold-away ramp (not shown) coupled to the stationary support structure 101 that is operable to facilitate transfer of one or more loads with respect to the platform 106. In a further embodiment, the deck 100 further includes, but is not limited to, at least one guard rail 304 associated with the platform 106. In a further embodiment, the deck 100 further includes, but is not limited to, a hoist 121 with a scale (not visible). In a further embodiment, the deck 100 further includes, but is not limited to, a hoist 121 that is height adjustable relative to the stationary support structure 101. In a further embodiment, the deck 100 further includes, but is not limited to, a hoist 121 that is position adjustable along a length of the stationary support structure 101. In a further embodiment, the deck 100 further includes, but is not limited to, a hoist 121 that is removably mounted on the stationary support structure 101.

In certain embodiments, the plate 108 is mounted in a different plane, such as in a middle or on top of the first 102 and second 104 box tubes. Likewise, the platform 106 can be positioned higher or lower relative to the plate 108 and the first 102 and second 104 box tubes. Similarly the hydraulic 110 can be positioned higher or lower relative to the plate 108 and the first 102 and second 104 box tubes. Also, the hydraulic 110 can be differently configured or positioned, such as to project through the plate 108, be shifted to one side, or be mounted on or in one of the first 102 and second 104 box tubes. Alternatively, the hydraulic 110 can be mounted instead to the platform 106 or the first extension member 112 or the second extension member 114 or the beam 116 in reverse as to that illustrated.

Figure 4:
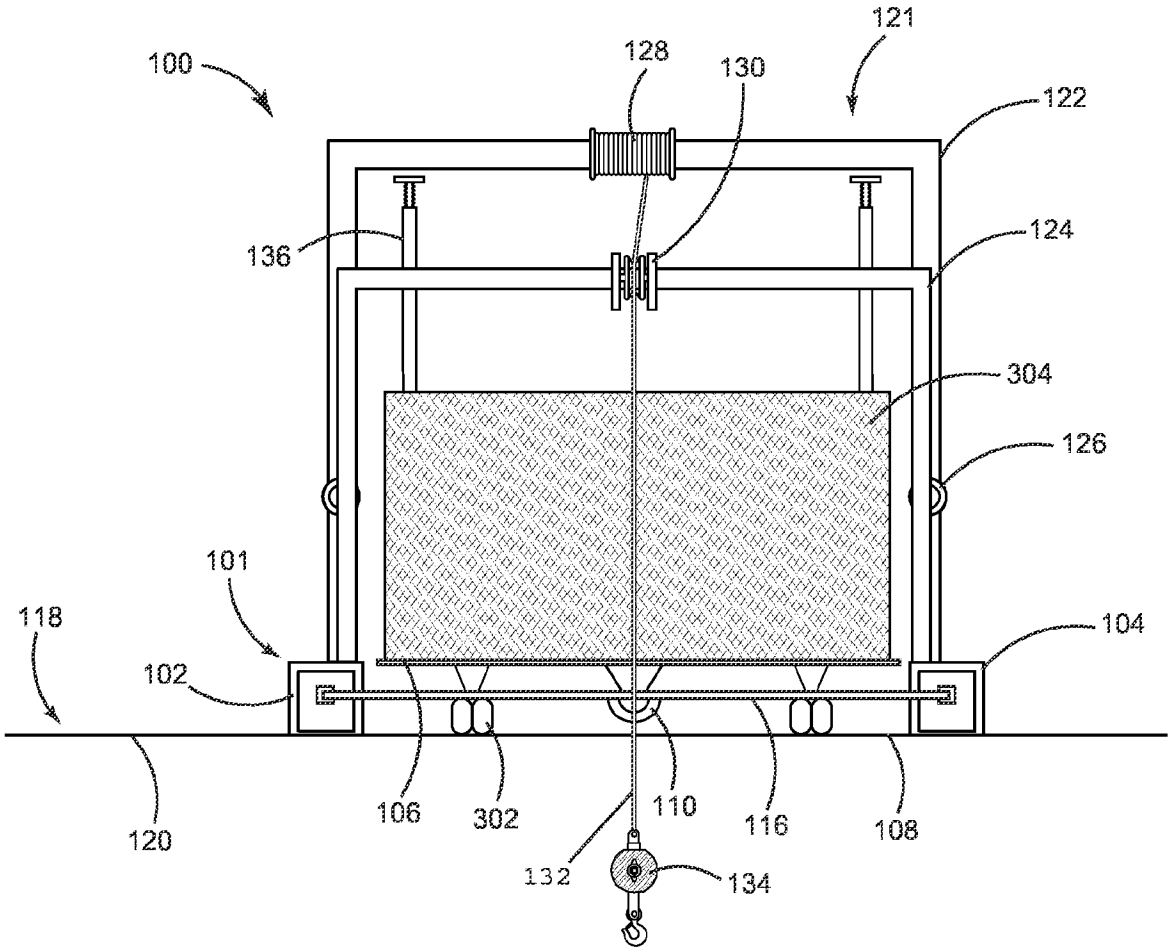
FIG. 4 is a front side view of a deck, in accordance with an embodiment of the invention.

FIG. 4 is a front side view of a deck (i.e., from the perspective of outside a building looking toward an inside of the building when the deck is being used), in accordance with an embodiment of the invention. In one embodiment, a deck 100 is provided for use in construction, the deck 100 including, but not limited to, a stationary support structure 101 that is positionable on a floor 118 of a building, the stationary support structure 101 including at least a first box tube 102; a second box tube 104 disposed substantially parallel to the first box tube 102; a plate 108 that extends between the first box tube 102 and the second box tube 104; and at least one hydraulic cylinder 110 mounted on the plate 108; a first extension member (not visible) that is slidably disposed within the first box tube 102; a second extension member (not visible) that is slidably disposed within the second box tube 104; a beam 116 that extends between the first (not visible) and second (not visible) extension members, the beam 116 coupled to the at least one hydraulic cylinder 110; and a platform 106 that is detached from the first box tube 102 and the second box tube 104 and that is coupled to the beam 116, the platform 106 including at least one wheel 302 operable to roll on the plate 108 for distributing at least some weight from the platform 106 to the floor 118 of the building, wherein the platform 106 is operable to retractably extend beyond an edge 120 of the floor 118 in conjunction with the first (not visible) and second (not visible) extension members in response to actuation of the at least one hydraulic cylinder 110.

In a further embodiment, the deck 100 further includes, but is not limited to, a hoist 121 operable to project from inside the edge 120 of the floor 118 to a point beyond the edge 120 of the floor 118, the hoist 121 including at least a mast 122 mounted on the stationary support structure 101 (e.g., on the first 102 and the second 104 box tubes); at least one boom 124 that projects from the mast 122 or the stationary support structure 101 (e.g., from the first 102 and the second 104 box tubes); a luffing device 126 (e.g. a hydraulic cylinder or cable) that extends from the mast 122 to the at least one boom 124 for adjusting pitch or angle of the at least one boom 124; a winch 128; a sheave 130; a cable 132 that extends from the winch 128 over the sheave 130; and an overhaul ball 134 coupled to the cable 132.

In a further embodiment, the deck 100 further includes, but is not limited to, at least one scale (not visible) associated with the platform 106. In a further embodiment, the deck 100 further includes, but is not limited to, at least one shore post 136 that extends from the stationary support structure 101. In a further embodiment, the deck 100 further includes, but is not limited to, at least one counterweight receptacle (not visible) coupled to the stationary support structure 101 that is operable to removably receive one or more counterweights (not visible). In a further embodiment, the deck 100 further includes, but is not limited to, one or more removable counterweights (not visible). In a further embodiment, the deck 100 further includes, but is not limited to, a fold-away ramp (not visible) coupled to the stationary support structure 101 that is operable to facilitate transfer of one or more loads with respect to the platform 106. In a further embodiment, the deck 100 further includes, but is not limited to, at least one guard rail 304 associated with the platform 106. In a further embodiment, the deck 100 further includes, but is not limited to, a hoist 121 with a scale (not visible). In a further embodiment, the deck 100 further includes, but is not limited to, a hoist 121 that is height adjustable relative to the stationary support structure 101. In a further embodiment, the deck 100 further includes, but is not limited to, a hoist 121 that is position adjustable along a length of the stationary support structure 101. In a further embodiment, the deck 100 further includes, but is not limited to, a hoist 121 that is removably mounted on the stationary support structure 101.

In certain embodiments, the at least one wheel 302 includes two or more wheels. The at least one wheel 302 can be coupled to the platform 106 at an aft-most position. Alternatively, the at least one wheel 302 can be coupled to the platform 106 along one or more sides of the platform 106. Additionally, the at least one wheel 302 can include two or more wheels that are distributed in varying positions relative to the platform 106. In one particular embodiment, the at least one wheel 302 can be coupled to the plate 108 such that the platform 106 can slide on the at least one wheel 302. In certain embodiments, the first (not visible) and second (not visible) extension members are positionable outside the first 102 and second 104 box tubes (e.g., on an inside, top, or outside). In situations where the first 102 and second 104 box tubes are substituted with one or more beams, rails, poles, guides, etc., the first (not visible) and second (not visible) extension members can slide thereon using one or more magnets, wheels, rollers, bearings, pads, or the like. In certain embodiments, the boom 124 can be coupled to the stationary support structure 101 or to the mast 122. In situations where the boom 124 is coupled to the mast, the boom 124 can be coupled on opposing sides of the mast 122 or to a top of the mast 122. The boom 124 can articulate, rotate, extend, retract, or the like. In certain embodiments, the luffing device 126 includes two hydraulic cylinders positioned on opposing sides of the mast 122 and the boom 124. In other embodiments, the luffing device 126 is positioned on a top of the mast 122 or on the stationary support structure 101. In additional embodiments, the luffing device 126 is fixed and non-luffing. In other embodiments, the luffing device 126 is omitted and a brace is incorporated into the boom 124. In some embodiments, the platform 106 is rotatable or includes a rotatable portion to rotate any load thereon (such as a package, a crate, a supply, a container, a component, a machine, etc.). In other embodiments, the platform 106 is configured to tilt, such as forward, sideways, or aft. In yet another embodiment, the platform 106 is configured to lower and/or lift. In certain embodiments, the mast 122 is differently configured. The mast 122 may be composed of two members that extend at an angle from the stationary support structure 101 to meet together. The mast 122 can also be a single member that extends from one side of the stationary support structure. In certain embodiments, the winch 128 is hydraulic or electric.

Figure 5:
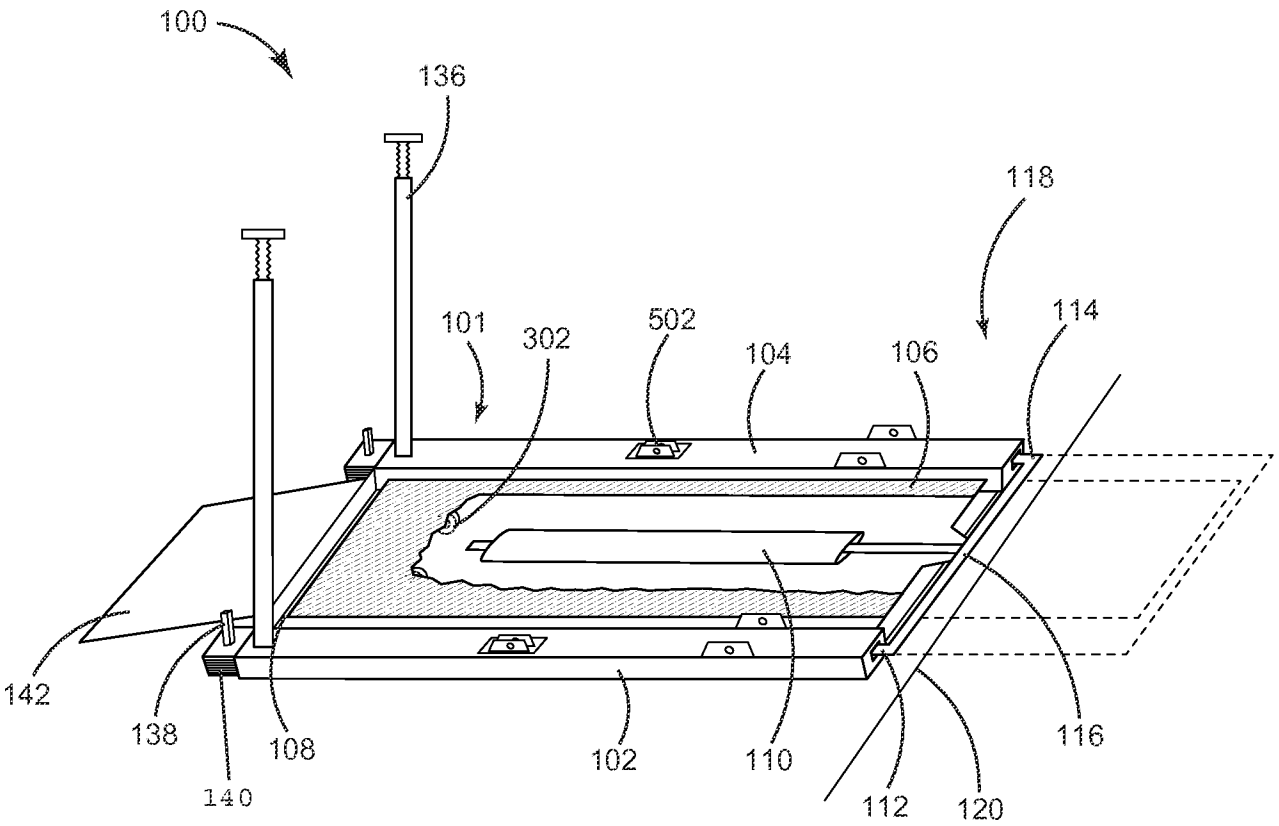
FIG. 5 is a perspective partially exposed view of a deck, in accordance with an embodiment of the invention.

FIG. 5 is a perspective partially exposed view of a deck 100, in accordance with an embodiment of the invention. In one embodiment, a deck 100 is provided for use in construction, the deck 100 including, but not limited to, a stationary support structure 101 that is positionable on a floor 118 of a building, the stationary support structure 101 including at least a first box tube 102; a second box tube 104 disposed substantially parallel to the first box tube 102; a plate 108 that extends between the first box tube 102 and the second box tube 104; and at least one hydraulic cylinder 110 mounted on the plate 108; a first extension member 112 that is slidably disposed within the first box tube 102; a second extension member 114 that is slidably disposed within the second box tube 104; a beam 116 that extends between the first 112 and second 114 extension members, the beam 116 coupled to the at least one hydraulic cylinder 110; and a platform 106 that is detached from the first box tube 102 and the second box tube 104 and that is coupled to the beam 116, the platform 106 including at least one wheel 302 operable to roll on the plate 108 for distributing at least some weight from the platform 106 to the floor 118 of the building, wherein the platform 106 is operable to retractably extend beyond an edge 120 of the floor 118 in conjunction with the first 112 and second 114 extension members in response to actuation of the at least one hydraulic cylinder 110. In a further embodiment, the deck 100 can include a hoist (not shown). The hoist is removably couplable to the stationary support structure using one or more brackets 502. The hoist can include any of the features disclosed herein.

In a further embodiment, the deck 100 further includes, but is not limited to, at least one scale (not visible) associated with the platform 106. In a further embodiment, the deck 100 further includes, but is not limited to, at least one shore post 136 that extends from the stationary support structure 101. In a further embodiment, the deck 100 further includes, but is not limited to, at least one counterweight receptacle 138 coupled to the stationary support structure 101 that is operable to removably receive one or more counterweights 140. In a further embodiment, the deck 100 further includes, but is not limited to, one or more removable counterweights 140. In a further embodiment, the deck 100 further includes, but is not limited to, a fold-away ramp 142 coupled to the stationary support structure 101 that is operable to facilitate transfer of one or more loads with respect to the platform 106. In a further embodiment, the deck 100 further includes, but is not limited to, at least one guard rail (not shown) associated with the platform 106. In a further embodiment, the deck 100 further includes, but is not limited to, a hoist 121 with a scale (not shown).

In certain embodiments, the fold-away ramp 142 is not foldable. The fold-away ramp 142 may be a ramp that lifts/lowers, which may be foldable or not. In certain embodiments, the counterweight receptacle 138 includes two receptacles, one on each side of the stationary support structure 101 (as depicted). However, the counterweight receptacle 138 may be a single receptacle. Also, the counterweight receptacle 138 may be differently configured, such as to span across the stationary support structure 101. Alternatively, the counterweight receptacle 138 can be differently positioned relative to the stationary support structure 101 such as on top or along a side of the stationary support structure 101. There can be a counterweight receptacle 138 located on or in association with the platform 106, such as at an aft position on the platform 106. In certain embodiments, the first 112 and second 114 extension members and the beam 116 are a unitary structure. In certain embodiments the platform 106 included in that unitary structure. In certain embodiments, the at least one hydraulic cylinder 110 includes two or more hydraulic cylinders. In certain embodiments, the brackets 502 are positioned in a track, or are otherwise movable, to enable position adjustment for any hoist. In certain embodiments, the at least one wheel 302 may be differently positioned or may include two or more wheels distributed at different positions under the platform 106. In certain embodiments, the platform 106 includes one or more wheels, rollers, bearings, pads, magnets, or the like (not shown) on one or both sides to facilitate movement of the platform 106 relative to the stationary support structure 101.

Figure 6:
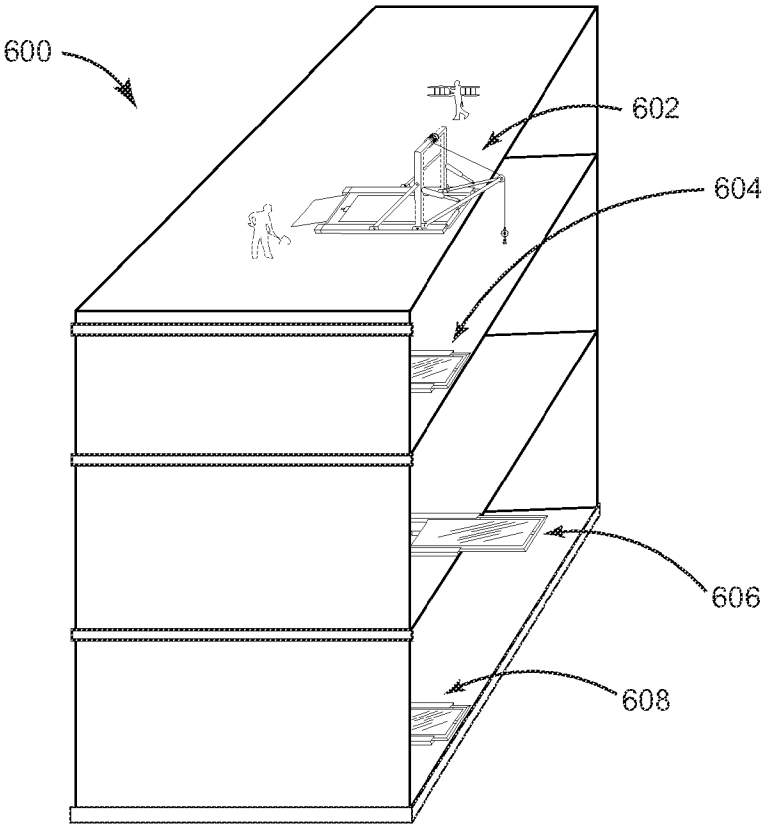
FIG. 6 is a perspective view of building under construction having multiple decks on different floors, in accordance with an embodiment of the invention.

FIG. 6 is a perspective view of building 600 under construction having multiple decks 602, 604, 606, and 608 on different floors, in accordance with an embodiment of the invention. Any of the decks 602, 604, 606, and 608 may include any of the features disclosed herein. For instance, deck 602 includes a hoist, which enables lifting of loads onto and from itself, but also lifting of loads onto and from any of the decks 604, 606, and 608. Thus, the hoist of deck 602 can lift a load from itself or from any of decks 604, 606, and 608 and lower or raise the load to any other deck or to the ground. Likewise, the hoist of deck 602 can lift a load from the ground and deliver the load to itself or any other deck 604, 606, and 608. Thus, no separate crane is required. However, a crane or another independent lifting device may also lift loads onto, from, or between any of the decks 602, 604, 606, and 608.

Additionally, the decks 602, 604, 606, and 608 are independently extendable and/or retractable from a floor edge. Thus, the decks 602, 604, 606, and 608 can be retracted completely or partially inside a floor edge when not in use or when being loaded, thereby eliminating and/or reducing interference of the deck with movement of loads by one or more machines (e.g., deck 602). Likewise, the hoist of deck 602 is also positioned inside a floor edge with the exception of a boom and sheave so as to eliminate and/or reduce interference of the hoist with movement of loads by one or more machines (e.g., a crane or other lifting device). Note that the boom and sheave of deck 602 can be further retracted so as to eliminate and/or reduce interference using a luffing device.

The decks 602, 604, 606, and 608 can carry increased weight on their respective platforms when extended past a floor edge because wheels located in the aft part of the platform distribute weight from the platform directly or indirectly to the floor. Counterweights can also be added to further increase the weight limits. These features enable the decks 602, 604, 606, and 608 to be used without shore posts or with less reliance on shore posts, which is beneficial when overlying structures are relatively weak (e.g., wood) or when there is no overlying structure (e.g., when on a roof).

Although shown used on a building, any of the decks 602, 604, 606, and 608 may be used in other contexts such as over a hole, over a side of a finished building, over a side of a boat or ship, in a manufacturing setting, in a retails setting, or any other location where it would be useful to raise, lower, extend, deliver, and/or receive loads.

Figure 7:
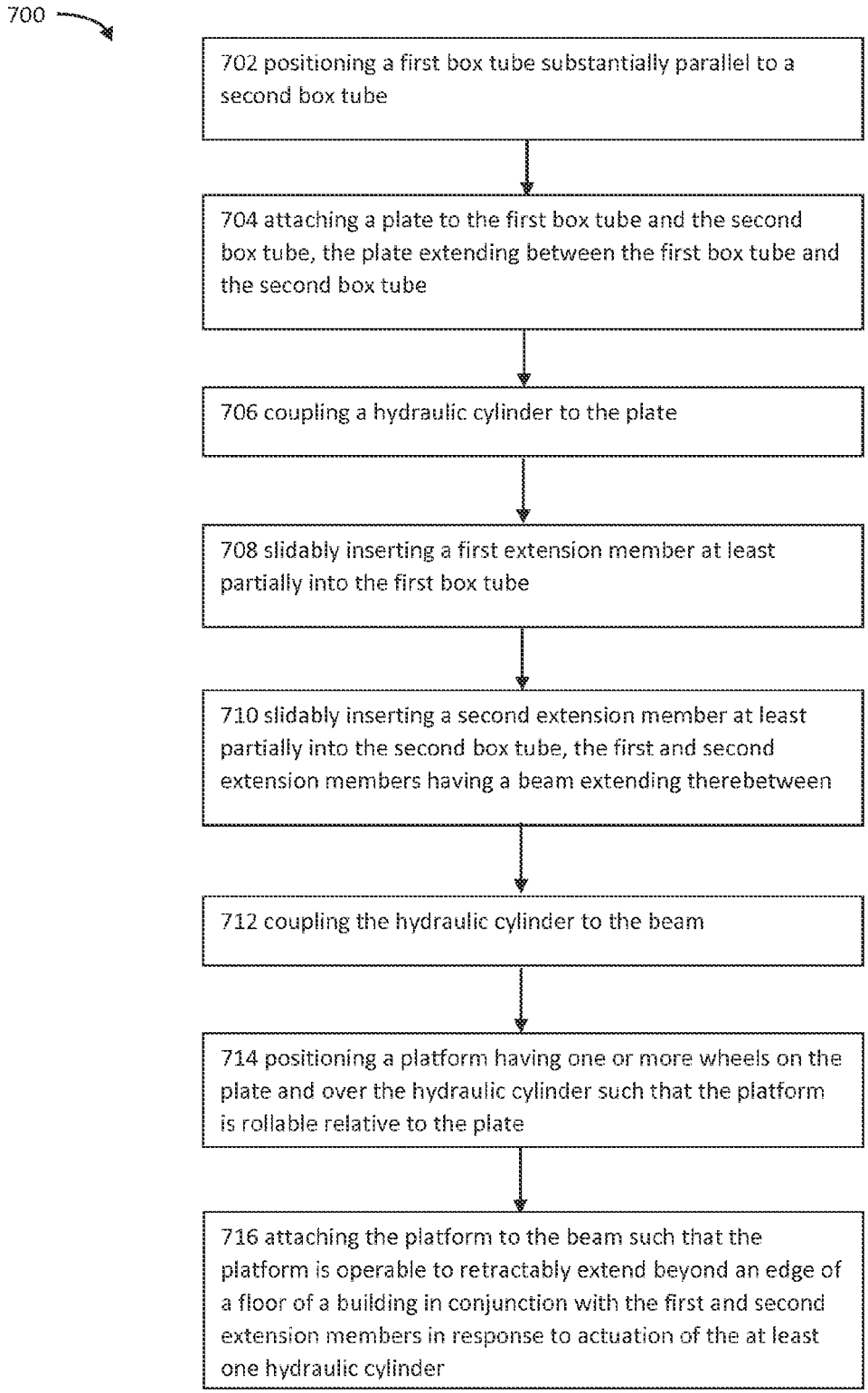
FIG. 7 is a flow diagram of a method for making a deck, in accordance with an embodiment of the invention.

FIG. 7 is a flow diagram of a method for making a deck, in accordance with an embodiment of the invention. In one embodiment, a method 700 includes, but is not limited to, positioning a first box tube substantially parallel to a second box tube at 702; attaching a plate to the first box tube and the second box tube, the plate extending between the first box tube and the second box tube at 704; coupling a hydraulic cylinder to the plate at 706; slidably inserting a first extension member at least partially into the first box tube at 708; slidably inserting a second extension member at least partially into the second box tube, the first and second extension members having a beam extending therebetween at 710; coupling the hydraulic cylinder to the beam at 712; positioning a platform having one or more wheels on the plate and over the hydraulic cylinder such that the platform is rollable relative to the plate at 714; and attaching the platform to the beam such that the platform is operable to retractably extend beyond an edge of a floor of a building in conjunction with the first and second extension members in response to actuation of the at least one hydraulic cylinder at 716. Method 700 may include use of or substitution with any of the features disclosed herein.

Figure 8:
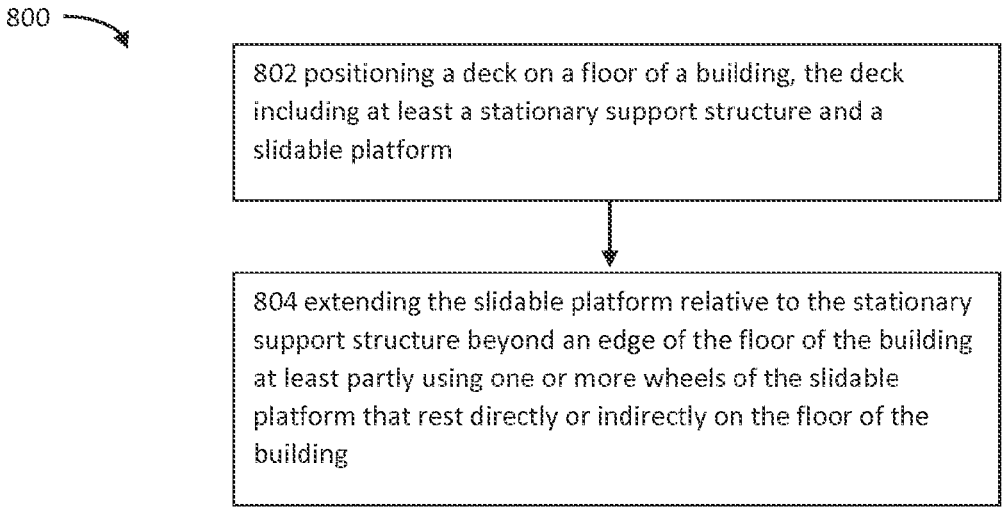
FIG. 8 is a flow diagram of a method for using a deck, in accordance with an embodiment of the invention.

FIG. 8 is a flow diagram of a method for using a deck, in accordance with an embodiment of the invention. In one embodiment, a technique 800 includes, but is not limited to, positioning a deck on a floor of a building, the deck including at least a stationary support structure and a slidable platform at 802; and extending the slidable platform relative to the stationary support structure beyond an edge of the floor of the building at least partly using one or more wheels of the slidable platform that rest directly or indirectly on the floor of the building at 804. Technique 800 may include use of or substitution with any of the features disclosed herein.

While preferred and alternate embodiments of the invention have been illustrated and described, as noted above, many changes can be made without departing from the spirit and scope of the invention. For example, in one embodiment, a deck for use in construction includes, but is not limited to, at least one fixed member positionable on a floor of a building, the at least one fixed member including at least one drive mechanism coupled thereto or disposed therein; at least one extension member that is coupled to the at least one drive mechanism, the at least one extension member operable to retractably extend from the at least one fixed member beyond an edge of the floor in response to actuation of the at least one drive mechanism; and a platform that is detached from the at least one fixed member and that is coupled to the at least one extension member such that the platform is operable to retractably extend beyond the edge of the floor in conjunction with the at least one extension member, the platform including at least one wheel operable to interface directly or indirectly with the floor of the building for distributing at least some weight from the platform to the floor of the building. In this embodiment, the at least one fixed member can include any of an i-beam, a beam, a pole, a plate, a rod, a track, a rail, a guide, a shaft, a column, a bar, a stud, a girder, a joist, a rafter, a truss, a floor, or the like. Furthermore, the at least one drive mechanism can include any of a hydraulic, a chain, a motor, a magnet, a self-propelled wheel, a screw, a cable, or the like. Additionally, the at least one extension member can include any of a beam, an i-beam, a pole, a plate, a rod, a shaft, a column, a bar, a stud, a tube, a box tube, or the like. Moreover, the platform may include any of a deck, a plate, a bar, a floor, a pole, an i-beam, a beam, a rod, a shaft, a column, or even a hanging structure such as a strap, net, bag, rope, cable, or the like. The platform can be integral with the at least one extension member. Additionally, the at least one wheel can include any of a roller, a bearing, a magnet, a skid, a pad, or the like.

In another embodiment, a deck for use in construction includes, but is not limited to, a stationary support structure that is positionable on a floor of a building, at least one extension member that is operable to retractably extend from the stationary support structure; and a platform that includes one or more wheels for interfacing directly or indirectly with the floor and that is coupled to the at least one extension member, wherein the platform is operable to retractably extend beyond an edge of the floor in conjunction with the at least one extension member. In this embodiment, the at least one stationary support structure can include any of an i-beam, a beam, a pole, a plate, a rod, a track, a rail, a guide, a shaft, a column, a bar, a stud, a girder, a joist, a rafter, a truss, a floor, or the like. Additionally, the at least one extension member can include any of a beam, an i-beam, a pole, a plate, a rod, a shaft, a column, a bar, a stud, a tube, a box tube, or the like. Moreover, the platform may include any of a deck, a plate, a bar, a floor, a pole, an i-beam, a beam, a rod, a shaft, a column, or even a hanging structure such as a strap, net, bag, rope, cable, or the like. The platform can be integral with the at least one extension member. Additionally, the one or more wheels can include any of a roller, a bearing, a magnet, a skid, a pad, or the like.

In one embodiment, a deck for use in construction includes, but is not limited to, a stationary support structure that is positionable on a floor of a building and that includes at least one counterweight receptacle; at least one extension member that is operable to retractably extend from the stationary support structure; a platform that includes one or more wheels for interfacing directly or indirectly with the floor and that is coupled to the at least one extension member, wherein the platform is operable to retractably extend beyond an edge of the floor in conjunction with the at least one extension member; and a hoist mounted on the stationary support structure such that the hoist is operable to project from inside the edge of the floor to a point beyond the edge of the floor for lifting one or more loads. In this embodiment, the at least one stationary support structure can include any of an i-beam, a beam, a pole, a plate, a rod, a track, a rail, a guide, a shaft, a column, a bar, a stud, a girder, a joist, a rafter, a truss, a floor, or the like. Furthermore, the at least one counterweight receptacle can include any of a box, a bin, a mount, a pole, a strap, a hook, a plate, clamp, a screw, a linkage, or the like. Hardware may be included to attach the stationary support structure to an underlying structure, such as a floor. Additionally, the at least one extension member can include any of a beam, an i-beam, a pole, a plate, a rod, a shaft, a column, a bar, a stud, a tube, a box tube, or the like. Moreover, the platform may include any of a deck, a plate, a bar, a floor, a pole, an i-beam, a beam, a rod, a shaft, a column, or even a hanging structure such as a strap, net, bag, rope, cable, or the like. The platform can be integral with the at least one extension member. Additionally, the one or more wheels can include any of a roller, a bearing, a magnet, a skid, a pad, or the like. Further, the hoist may include any lifting device or mechanism.

In one embodiment, a hoist for use in construction is provided that includes, but is not limited to, a stationary support structure; a mast mounted on the stationary support structure; at least one boom that projects from the stationary support structure or the mast; and a platform slidable relative to the stationary support structure for receiving or delivery one or more loads, wherein the hoist is operable to project from inside an edge of a floor of a building to a point beyond the edge of the floor for lifting or depositing the one or more loads with respect to the platform. In this embodiment, the at least one stationary support structure can include any of an i-beam, a beam, a pole, a plate, a rod, a track, a rail, a guide, a shaft, a column, a bar, a stud, a girder, a joist, a rafter, a truss, a floor, or the like. Similarly, the mast can include any of an i-beam, a beam, a pole, a plate, a rod, a shaft, a column, a bar, a stud, a box tube, a tube, or the like. Likewise, the at least one boom can include any of an i-beam, a beam, a pole, a plate, a rod, a shaft, a column, a bar, a stud, a box tube, a tube, or the like. Moreover, the platform may include any of a deck, a plate, a bar, a floor, a pole, an i-beam, a beam, a rod, a shaft, a column, or even a hanging structure such as a strap, net, bag, rope, cable, or the like. The platform may be slidable using one or more bearings, wheels, skids, pads, magnets, chains, gears, or the like.

In one embodiment, a hoist for use in building construction includes, but is not limited to, a stationary support structure positionable on a floor of a building; a lift coupled to the stationary support structure; and a platform slidable relative to the stationary support structure at least partly using one or more rollers or wheels operable to interface directly or indirectly with the floor, wherein the lift is operable to project from inside an edge of the floor of the building to a point beyond the edge of the floor for lifting or depositing one or more loads with respect to the platform. In this embodiment, the at least one stationary support structure can include any of an i-beam, a beam, a pole, a plate, a rod, a track, a rail, a guide, a shaft, a column, a bar, a stud, a girder, a joist, a rafter, a truss, a floor, or the like. Furthermore, the lift can include any of cables, pulleys, wires, gears, or the like, any of which may be slidable along a track. The lift can include an electric, hydraulic, or motor. Moreover, the platform may include any of a deck, a plate, a bar, a floor, a pole, an i-beam, a beam, a rod, a shaft, a column, or even a hanging structure such as a strap, net, bag, rope, cable, or the like. Additionally, the one or more rollers or wheels may include any of a bearing, a magnet, a chain, a gear, or the like.

Accordingly, the scope of the invention is not limited by the disclosure of these preferred and alternate embodiments. Instead, the invention should be determined by reference to the claims that follow.

What is claimed is:

1. A hoist system for use in construction, the system comprising:

a stationary support structure positioned completely inside an edge of a floor of a building;

a hoist fixedly secured to the stationary support structure, which hoist projects beyond the edge of the floor of the building; and a platform including one or more wheels to support the platform, the platform being slidable to retractably extend the platform at least partly beyond the edge of the floor of the building relative to the stationary support structure.

2. The hoist system of claim 1, wherein the platform retractably extends partly beyond the edge of the floor of the building to increase a load capacity of the platform and minimize counter-balancing requirements.

3. The hoist system of claim 1, wherein the hoist is coupled to the stationary support structure that is positioned completely inside the edge of the floor of the building to increase a load capacity of the platform and minimize counter-balancing requirements.

4. The hoist system of claim 1, further comprising:

one or more extension members that are retractably extendable relative to the stationary support structure between a first retracted position and a second extended position, wherein the platform is coupled to the one or more extension members.

5. The hoist system of claim 1, wherein the hoist comprises a boom that projects beyond the edge of the floor of the building.

6. The hoist system of claim 1, wherein the one or more wheels remain inside the edge of the floor of the building when the platform is extended.

7. The hoist system of claim 1, further comprising:

at least one shore post that extends from the stationary support structure.

8. The hoist system of claim 1, further comprising:

at least one counterweight receptacle coupled to the stationary support structure that is operable to removably receive one or more counterweights.

9. The hoist system of claim 1, wherein the building comprises one or more of the following: a finished building, a constructed building, or a building with a hole.

10. The hoist system of claim 1, further comprising:

a ramp that is coupled to the stationary support structure to facilitate transfer of one or more loads onto or from the platform.

11. The hoist system of claim 1, further comprising:

at least one guard rail coupled to the platform.

12. The hoist system of claim 1, wherein the hoist comprises:

a mast mounted on the stationary support structure;

a winch coupled to the mast;

a boom extending from the mast or the stationary support structure;

a sheave coupled to the boom; and a cable extending from the winch over the sheave.

13. The hoist system of claim 1, wherein the hoist comprises:

a mast mounted on the stationary support structure, which mast is height adjustable.

14. The hoist system of claim 1, wherein the hoist comprises:

a mast mounted on the stationary support structure, which mast is position adjustable.

15. The hoist system of claim 1, wherein the hoist comprises:

a mast mounted on the stationary support structure, which mast is removable.

16. The hoist system of claim 1, wherein the hoist comprises:

a mast mounted on the stationary support structure;

a boom extending from the mast or the stationary support structure;

at least one back brace that extends from the mast to the stationary support structure; and at least one luffing front brace that extends from the mast to the boom.

17. The hoist system of claim 1, wherein the stationary support structure comprises:

a first support member;

a second support member disposed substantially parallel to the first support member;

a plate that extends between the first support member and the second support member; and at least one leverage device coupled to the plate and to the platform to assist in retraction and extension of the platform.

18. The hoist system of claim 17, further comprising:

a first extension member that is slidably disposed on or in the first support member;

a second extension member that is slidably disposed on or in the second support member; and a cross-beam extending between the first and second extension members, wherein the platform is coupled to the cross-beam at a first front end and wherein the platform is detached from the first support member and the second support member at a second rear end.

19. The hoist system of claim 18, further comprising:

a mast mounted on the stationary support structure;

a boom coupled to the mast or the stationary support structure, which boom projects beyond the edge of the floor of the building; and at least one luffing brace that extends from the mast to the boom.

* * * * *